US010837727B2

(12) United States Patent
Lee

(10) Patent No.: US 10,837,727 B2
(45) Date of Patent: Nov. 17, 2020

(54) MODULAR TRIGGER CONTROL UNIT FOR FIREARMS

(71) Applicant: Strike Industries, Inc., Santa Ana, CA (US)

(72) Inventor: Shanyao Lee, Santa Ana, CA (US)

(73) Assignee: Strike Industries, Inc., Santa Ana, CA (US)

( * ) Notice: Subject to any disclaimer, the term of this patent is extended or adjusted under 35 U.S.C. 154(b) by 0 days.

(21) Appl. No.: 16/718,825

(22) Filed: Dec. 18, 2019

(65) Prior Publication Data

US 2020/0191514 A1 Jun. 18, 2020

Related U.S. Application Data

(60) Provisional application No. 62/781,238, filed on Dec. 18, 2018.

(51) Int. Cl.
*F41A 19/32* (2006.01)
*F41A 19/10* (2006.01)
*F41A 3/66* (2006.01)

(52) U.S. Cl.
CPC ..... *F41A 19/32* (2013.01); *F41A 3/66* (2013.01); *F41A 19/10* (2013.01)

(58) Field of Classification Search
CPC .. F41A 19/32; F41A 3/66; F41A 19/10; F41A 11/02
USPC ..... 42/69.01, 69.02
See application file for complete search history.

(56) References Cited

U.S. PATENT DOCUMENTS 5,386,659 A * 2/1995 Vaid ..... F41A 19/32 42/69.02
5,669,169 A * 9/1997 Schmitter ..... F41A 3/66 42/75.01
6,263,607 B1 * 7/2001 Fuchs ..... F41A 17/36 42/70.01
7,392,611 B2 * 7/2008 Curry ..... F41A 11/00 42/106
2002/0053155 A1 * 5/2002 Johansson ..... F41A 19/31 42/69.02

FOREIGN PATENT DOCUMENTS

WO WO-2018152144 A1 * 8/2018 ..... F41A 11/02

* cited by examiner

*Primary Examiner* — Stephen Johnson
(74) *Attorney, Agent, or Firm* — Han IP PLLC; Andy M. Han

(57) ABSTRACT

Various examples of a modular trigger control unit for firearms are described. The trigger control unit can be removably installed on a grip frame and installed between the grip frame and a slide assembly of a semi-automatic firearm. The trigger control unit includes at least a trigger pin and a trigger pivotable around the trigger pin when pulled. In response to the trigger being pulled by a user when the trigger control unit is installed between the grip frame and the slide assembly, a firing pin lug of a striker-firing mechanism in the slide assembly is released thereby allowing a striker of the striker-firing mechanism to move forward with respect to the slide assembly. Moreover, the trigger control unit is secured to the grip frame at least by the trigger pin such that removal of the trigger control unit from the grip frame requires removal of the trigger pin.

11 Claims, 4 Drawing Sheets

MODULAR TRIGGER CONTROL UNIT FOR FIREARMS

CROSS REFERENCE TO RELATED PATENT APPLICATION(S)

The present disclosure is part of a non-provisional application claiming the priority benefit of U.S. Provisional Patent Application No. 62/781,238, filed 18 Dec. 2018, the content of which being incorporated by reference in its entirety.

TECHNICAL FIELD

The present disclosure is generally related to firearms and, more particularly, to a modular trigger control unit for firearms.

BACKGROUND

Unless otherwise indicated herein, approaches described in this section are not prior art to the claims listed below and are not admitted as prior art by inclusion in this section.

To enhance customization of firearms, modular systems have been introduced to the market for rifles, carbines and pistols alike. However, for pistols such as semi-automatic pistols, currently available modular systems are proprietary in that a fire control unit of a given vendor is designed to function only with proprietary grip frames and slide assemblies.

SUMMARY

The following summary is illustrative only and is not intended to be limiting in any way. That is, the following summary is provided to introduce concepts, highlights, benefits and advantages of the novel and non-obvious techniques described herein. Select implementations are further described below in the detailed description. Thus, the following summary is not intended to identify essential features of the claimed subject matter, nor is it intended for use in determining the scope of the claimed subject matter.

An objective of the present disclosure is to provide a modular trigger control unit that can be installed on and function with a plurality of grip frames and slide assemblies of different sizes, colors and/or calibers to form a semi-automatic (e.g., striker-fired) firearm. With the serial number of the firearm is displayed on the trigger control unit, the modular trigger control unit enables firearm customization by a user.

In one aspect, a device may include a trigger control unit configured to be removably installed on a grip frame and installed between the grip frame and a slide assembly of a semi-automatic (e.g., striker-fired) firearm. The trigger control unit may include at least a trigger pin and a trigger pivotable around the trigger pin when pulled. In response to the trigger being pulled by a user when the trigger control unit is installed between the grip frame and the slide assembly, a firing pin lug of a striker-firing mechanism in the slide assembly may be released thereby allowing a striker of the striker-firing mechanism to move forward with respect to the slide assembly. Moreover, the trigger control unit may be secured to the grip frame at least by the trigger pin such that removal of the trigger control unit from the grip frame requires removal of the trigger pin.

In one aspect, a device may include a trigger control unit configured to be removably installed on a grip frame and installed between the grip frame and a slide assembly of a semi-automatic (e.g., striker-fired) firearm. The trigger control unit may include at least a trigger pin, a trigger pivotable around the trigger pin when pulled, and a pair of slide rails extending forward with respect to the grip frame. In response to the trigger being pulled by a user when the trigger control unit is installed between the grip frame and the slide assembly, a firing pin lug of a striker-firing mechanism in the slide assembly may be released thereby allowing a striker of the striker-firing mechanism to move forward with respect to the slide assembly. Moreover, when the trigger control unit is installed between the grip frame and the slide assembly, the slide assembly may be movable forwardly and backwardly with respect to the grip frame on the slide rails.

In one aspect, an apparatus may include a grip frame, a slide assembly containing a striker-firing mechanism therein, and a trigger control unit configured to be removably installed on the grip frame and installed between the grip frame and the slide assembly. The trigger control unit may include at least a trigger pin and a trigger pivotable around the trigger pin when pulled. In response to the trigger being pulled by a user when the trigger control unit is installed between the grip frame and the slide assembly, a firing pin lug of the striker-firing mechanism in the slide assembly may be released thereby allowing a striker of the striker-firing mechanism to move forward with respect to the slide assembly. Moreover, the trigger control unit may be secured to the grip frame at least by the trigger pin such that removal of the trigger control unit from the grip frame requires removal of the trigger pin.

BRIEF DESCRIPTION OF THE DRAWINGS

The accompanying drawings are included to provide a further understanding of the disclosure, and are incorporated in and constitute a part of the present disclosure. The drawings illustrate implementations of the disclosure and, together with the description, serve to explain the principles of the disclosure. It is appreciable that the drawings are not necessarily in scale as some components may be shown to be out of proportion than the size in actual implementation in order to clearly illustrate the concept of the present disclosure.

DETAILED DESCRIPTION OF PREFERRED IMPLEMENTATIONS

Detailed embodiments and implementations of the claimed subject matters are disclosed herein. However, it shall be understood that the disclosed embodiments and implementations are merely illustrative of the claimed subject matters which may be embodied in various forms. The present disclosure may, however, be embodied in many different forms and should not be construed as limited to the exemplary embodiments and implementations set forth herein. Rather, these exemplary embodiments and implementations are provided so that description of the present disclosure is thorough and complete and will fully convey the scope of the present disclosure to those skilled in the art. In the description below, details of well-known features and techniques may be omitted to avoid unnecessarily obscuring the presented embodiments and implementations.

Overview

Under various proposed schemes in accordance with the present disclosure, a portable trigger control unit offers modularity and a great degree of customization of firearms such as, for example, semi-automatic pistols. The trigger control unit may be utilized with different grip frames of different sizes and/or colors as well as different slide assemblies of different sizes, colors and/or calibers. It is noteworthy that, although examples in the present disclosure are provided in the context of a striker-fired pistol, the proposed schemes in accordance with the present disclosure may be implemented in different types of firearms (e.g., hammer-fired pistols or semi-automatic rifles and carbines).

Illustrative Implementations

Figure 1:
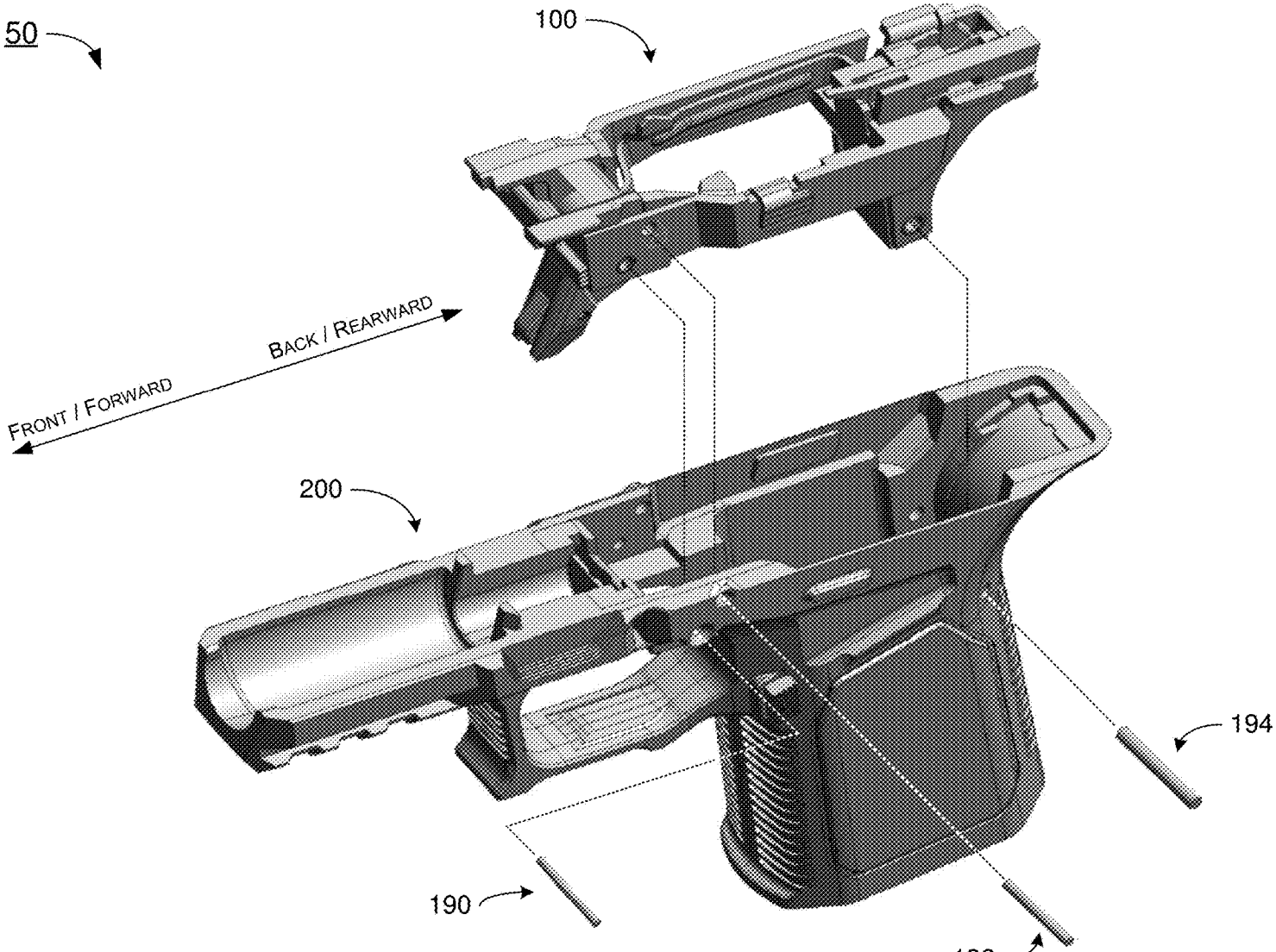
FIG. 1 is a diagram of some of the components of a firearm in accordance with an implementation of the present disclosure.

FIG. 1 illustrates some of the components of a firearm 50 in accordance with an implementation of the present disclosure. Referring to FIG. 1, firearm 50 may include a portable firing control unit or trigger control unit 100 and a grip frame 200. Under the proposed schemes, a serial number of firearm 50 may be displayed on a portion (e.g., right side or left side) of trigger control unit 100 so that, when the trigger control unit 100 is received, mounted or otherwise installed in grip frame 200 the serial number of firearm 50 may be visible through a cutout or opening on grip frame 200 on the same side (e.g., right side or left side) of trigger control unit 100 where the serial number is displayed. Grip frame 200 may be made of a polymeric material. Alternatively, grip frame 200 may be made of metal or a composite of metal and polymer. Firearm 50, or trigger control unit 100, may also include a trigger pin 190, a locking block pin 192 and a trigger housing pin 194.

Trigger control unit 100 may be removably installed on grip frame 200. Accordingly, at any given time, a user may install the same trigger control unit 100 in one of different grip frames of different or same colors or for different or same calibers. For instance, a user may install the same trigger control unit 100 in a grip frame in black color for a pistol chambered in 9 mm caliber, in a grip frame in flat dark earth (FDE) color for another pistol chambered in 9 mm caliber, or in a grip frame for a pistol chambered in 45ACP caliber.

Trigger control unit 100 may be secured to grip frame 200 at least by trigger pin 190 such that removal of trigger control unit 100 from grip frame 200 would require removal of trigger pin 190 first. In some cases, trigger control unit 100 may also be secured to grip frame 200 by trigger housing pin 194 and/or locking block pin 192.

Figure 2:
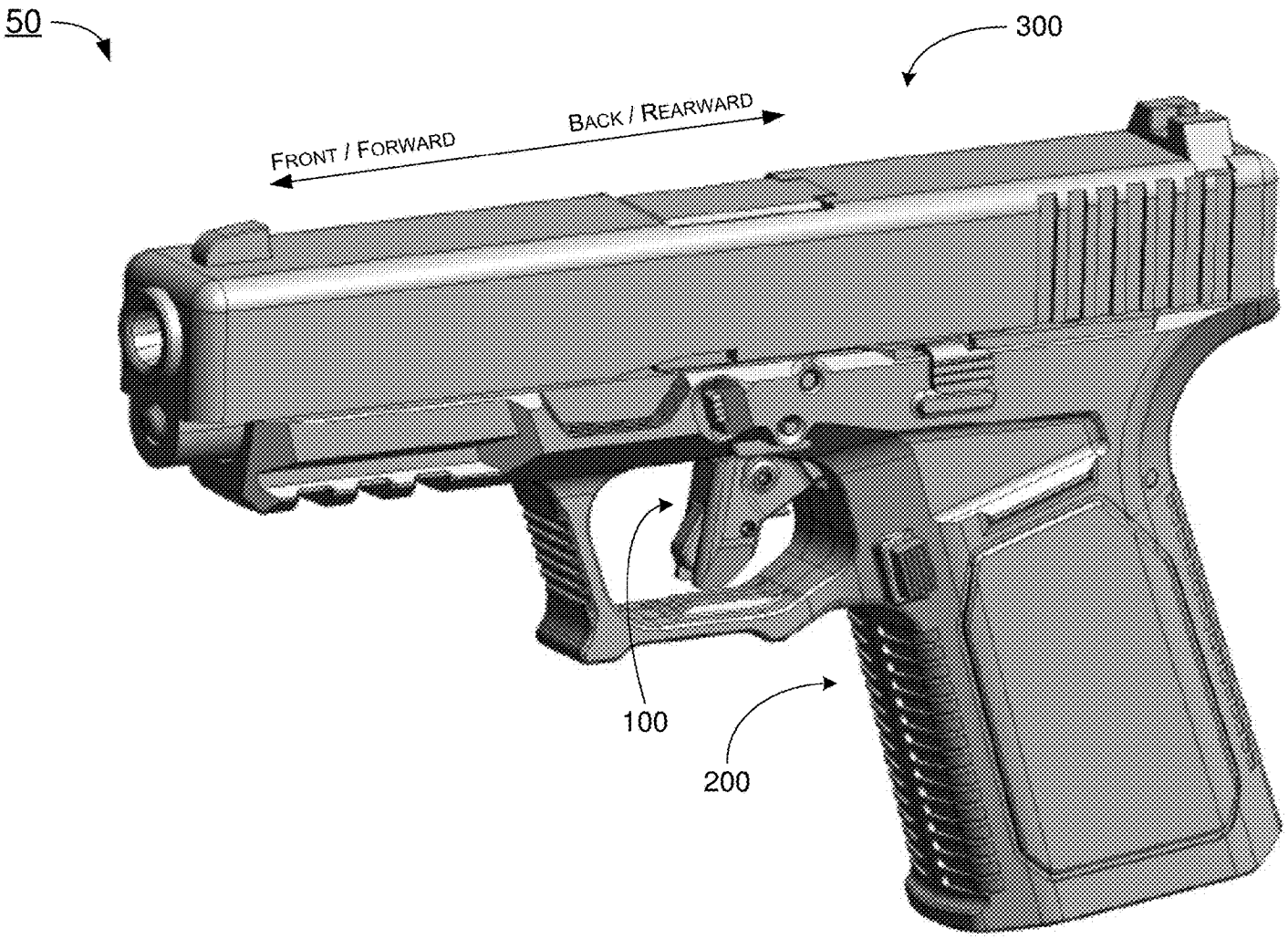
FIG. 2 is a diagram of a firearm in accordance with an implementation of the present disclosure.

FIG. 2 illustrates firearm 50 in accordance with an implementation of the present disclosure. Referring to FIG. 2, in addition to trigger control unit 100 and grip frame 200, firearm 50 may also include a slide assembly 300. Trigger control unit 100 may be installed between grip frame 200 and slide assembly 300. In the example shown in FIG. 2, slide assembly 300 may contain a striker-firing mechanism 350 (shown in FIG. 3), a barrel and a recoil spring assembly therein.

Figure 3:
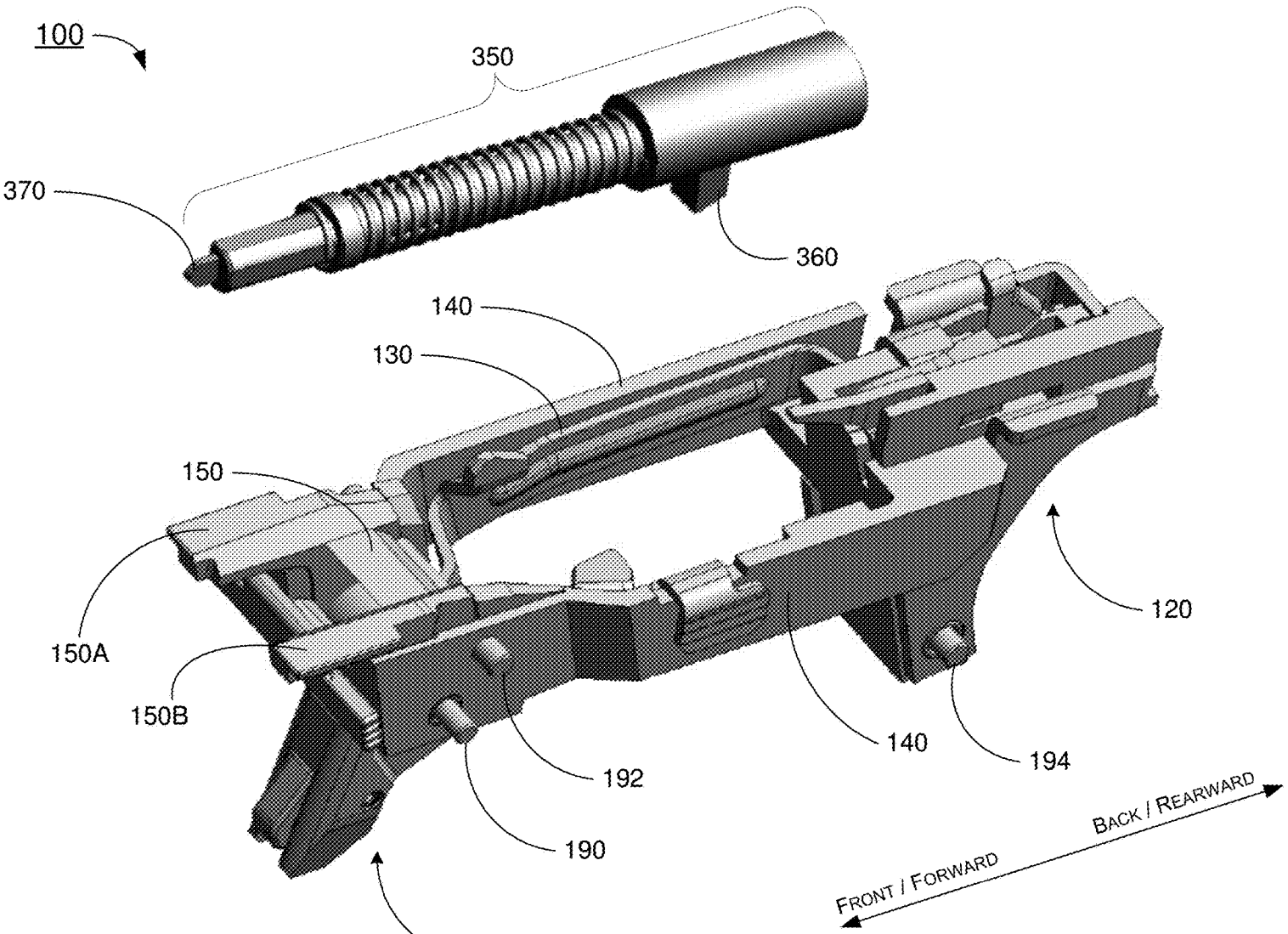
FIG. 3 is a diagram of a portable trigger control unit in accordance with an implementation of the present disclosure.
Figure 4:
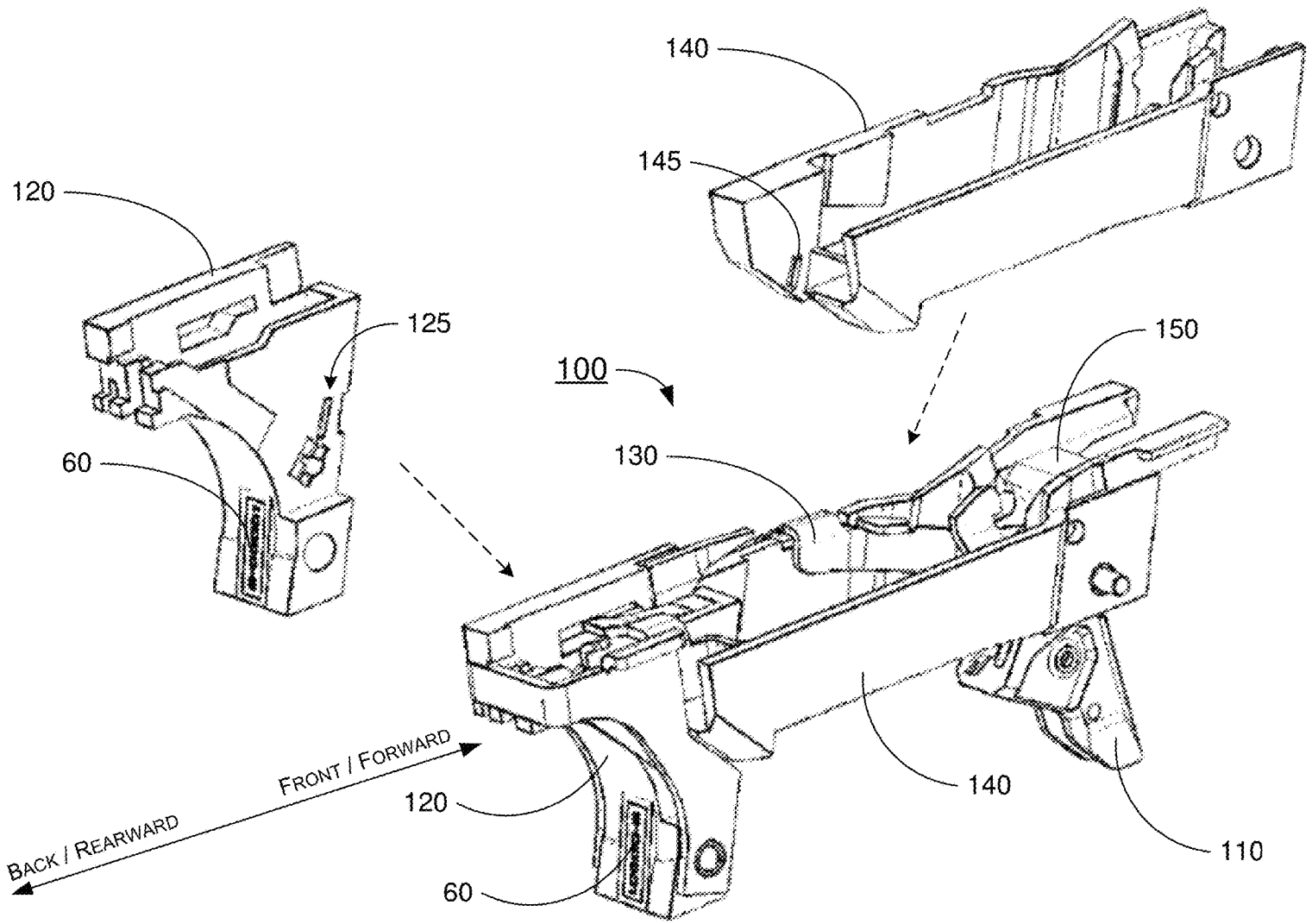
FIG. 4 is a diagram of some components of the firearm.

FIG. 3 illustrates portable trigger control unit 100 in accordance with an implementation of the present disclosure. Referring to FIG. 3, in addition to trigger pin 190, locking block pin 192 and trigger housing pin 194, trigger control unit 100 may also include a trigger 110, a trigger mechanism housing 120, a trigger bar 130, a support frame 140, and a locking block 150 with a pair of slide rails 150A and 150B.

Trigger 110 may be pivotable around trigger pin 190 when pulled by a user. In response to trigger 110 being pulled by the user when trigger control unit 100 is installed between grip frame 200 and slide assembly 300, a firing pin lug 360 of the striker-firing mechanism 350 in slide assembly 300 may be released thereby allowing a striker 370 of the striker-firing mechanism 350 to move forward with respect to slide assembly 300. Thus, a user can grip the grip frame 200 and squeeze trigger 110 of trigger control unit 100, among other actions, to fire a round of ammunition.

Trigger bar 130 may be coupled between trigger 1110 and the trigger mechanism housing 120. In response to trigger 110 being pulled by the user when trigger control unit 100 is installed between grip frame 200 and slide assembly 300, trigger bar 130 may cause a sear in the trigger mechanism housing to lower relative to slide assembly 300 such that the firing pin lug is released (e.g., to strike the primer of a round of ammunition if the round is chambered).

Support frame 140 may have a first distal end (e.g., front) and a second distal end (e.g., back) opposite the first distal end. Trigger 110 may be pivotably coupled to the first distal end of support frame 140 with trigger pin 190 traversing through trigger 110 and the first distal end of support frame 140. Moreover, trigger mechanism housing 120 may be coupled to the second distal end of support frame 140. Support frame 140 may be made of a polymeric material, metal or a composite of metal and polymer.

The pair of slide rails 150A and 150B of locking block 150 may extend forward and protrude from a front side of support frame 140 with respect to firearm 50. When trigger control unit 100 is installed between grip frame 200 and the slide assembly 300, slide assembly 300 may be movable forwardly and backwardly with respect to grip frame 200 on the slide rails 150A and 150B.

In terms of modularity and customization, trigger control unit 100 may be configured to be removably installed on each of a plurality of grip frames and installed between each of the plurality of grip frames and each of a plurality of slide assemblies such that: (a) at least two of the plurality of grip frames have different sizes, different colors, or different sizes and colors, and/or (b) at least two of the plurality of slide assemblies have different sizes, different colors, different calibers, or any combination thereof.

Feature Highlight

In view of the above, select features of various implementations in accordance with the present disclosure are highlighted below.

In one aspect, a device may include a trigger control unit configured to be removably installed on a grip frame and installed between the grip frame and a slide assembly of a semi-automatic (e.g., striker-fired) firearm. The trigger control unit may include at least a trigger pin and a trigger pivotable around the trigger pin when pulled. In response to the trigger being pulled by a user when the trigger control unit is installed between the grip frame and the slide assembly, a firing pin lug of a striker-firing mechanism in the slide assembly may be released thereby allowing a striker of the striker-firing mechanism to move forward with respect to the slide assembly. Moreover, he trigger control unit may be secured to the grip frame at least by the trigger pin such that removal of the trigger control unit from the grip frame requires removal of the trigger pin.

In some implementations, the trigger control unit may further include a trigger mechanism housing and a trigger bar coupled between the trigger and the trigger mechanism housing. In response to the trigger being pulled by the user when the trigger control unit is installed between the grip frame and the slide assembly, the trigger bar may cause a sear in the trigger mechanism housing to lower relative to the slide assembly such that the firing pin lug is released.

In some implementations, the trigger control unit may further include a support frame having a first distal end and a second distal end opposite the first distal end. Accordingly, the trigger may be pivotably coupled to the first distal end of the support frame with the trigger pin traversing through the trigger and the first distal end of the support frame. Moreover, the trigger mechanism housing may be coupled to the second distal end of the support frame.

In some implementations, the support frame may be made of a polymeric material. Alternatively, support frame may be made of metal or a composite of metal and polymer.

In some implementations, the trigger control unit may further include a pair of slide rails extending forward from the support frame with respect to the firearm. Accordingly, when the trigger control unit is installed between the grip frame and the slide assembly, the slide assembly may be movable forwardly and backwardly with respect to the grip frame on the slide rails.

In some implementations, a serial number of the firearm may be displayed on the trigger control unit.

In some implementations, the trigger control unit may be configured to be removably installed on each of a plurality of grip frames and installed between each of the plurality of grip frames and each of a plurality of slide assemblies such that: (a) at least two of the plurality of grip frames have different sizes, different colors, or different sizes and colors, or (b) at least two of the plurality of slide assemblies have different sizes, different colors, different calibers, or any combination thereof.

In another aspect, a device may include a trigger control unit configured to be removably installed on a grip frame and installed between the grip frame and a slide assembly of a semi-automatic (e.g., striker-fired) firearm. The trigger control unit may include at least a trigger pin, a trigger pivotable around the trigger pin when pulled, and a pair of slide rails extending forward with respect to the grip frame. In response to the trigger being pulled by a user when the trigger control unit is installed between the grip frame and the slide assembly, a firing pin lug of a striker-firing mechanism in the slide assembly may be released thereby allowing a striker of the striker-firing mechanism to move forward with respect to the slide assembly. Moreover, when the trigger control unit is installed between the grip frame and the slide assembly, the slide assembly may be movable forwardly and backwardly with respect to the grip frame on the slide rails.

In some implementations, the trigger control unit may further include a trigger mechanism housing and a trigger bar coupled between the trigger and the trigger mechanism housing. In response to the trigger being pulled by the user when the trigger control unit is installed between the grip frame and the slide assembly, the trigger bar may cause a sear in the trigger mechanism housing to lower relative to the slide assembly such that the firing pin lug is released.

In some implementations, the trigger control unit may further include a support frame having a first distal end and a second distal end opposite the first distal end. Accordingly, the trigger may be pivotably coupled to the first distal end of the support frame with the trigger pin traversing through the trigger and the first distal end of the support frame. Moreover, the trigger mechanism housing may be coupled to the second distal end of the support frame.

In some implementations, the support frame may be made of a polymeric material. Alternatively, support frame may be made of metal or a composite of metal and polymer.

In some implementations, the trigger control unit may be secured to the grip frame at least by the trigger pin such that removal of the trigger control unit from the grip frame requires removal of the trigger pin.

In some implementations, a serial number of the firearm may be displayed on the trigger control unit.

In some implementations, the trigger control unit may be configured to be removably installed on each of a plurality of grip frames and installed between each of the plurality of grip frames and each of a plurality of slide assemblies such that: (a) at least two of the plurality of grip frames have different sizes, different colors, or different sizes and colors, or (b) at least two of the plurality of slide assemblies have different sizes, different colors, different calibers, or any combination thereof.

In one aspect, a firearm may include a grip frame, a slide assembly containing a striker-firing mechanism therein, and a trigger control unit configured to be removably installed on the grip frame and installed between the grip frame and the slide assembly. The trigger control unit may include at least a trigger pin and a trigger pivotable around the trigger pin when pulled. In response to the trigger being pulled by a user when the trigger control unit is installed between the grip frame and the slide assembly, a firing pin lug of the striker-firing mechanism in the slide assembly may be released thereby allowing a striker of the striker-firing mechanism to move forward with respect to the slide assembly. Moreover, the trigger control unit may be secured to the grip frame at least by the trigger pin such that removal of the trigger control unit from the grip frame requires removal of the trigger pin.

In some implementations, the trigger control unit may further include a trigger mechanism housing and a trigger bar coupled between the trigger and the trigger mechanism housing. In response to the trigger being pulled by the user when the trigger control unit is installed between the grip frame and the slide assembly, the trigger bar may cause a sear in the trigger mechanism housing to lower relative to the slide assembly such that the firing pin lug is released.

In some implementations, the trigger control unit may further include a support frame having a first distal end and a second distal end opposite the first distal end. Accordingly, the trigger may be pivotably coupled to the first distal end of the support frame with the trigger pin traversing through the trigger and the first distal end of the support frame. Moreover, the trigger mechanism housing may be coupled to the second distal end of the support frame.

In some implementations, the support frame may be made of a polymeric material. Alternatively, support frame may be made of metal or a composite of metal and polymer.

In some implementations, the trigger control unit may further include a pair of slide rails extending forward from the support frame with respect to the firearm. Accordingly, when the trigger control unit is installed between the grip frame and the slide assembly, the slide assembly may be movable forwardly and backwardly with respect to the grip frame on the slide rails.

In some implementations, a serial number of the firearm may be displayed on the trigger control unit.

Additional Notes

The herein-described subject matter sometimes illustrates different components contained within, or connected with, different other components. It is to be understood that such depicted architectures are merely examples, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

Further, with respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

Moreover, it will be understood by those skilled in the art that, in general, terms used herein, and especially in the appended claims, e.g., bodies of the appended claims, are generally intended as "open" terms, e.g., the term "including" should be interpreted as "including but not limited to," the term "having" should be interpreted as "having at least," the term "includes" should be interpreted as "includes but is not limited to," etc. It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to implementations containing only one such recitation, even when the same claim includes the introductory phrases "one or more" or "at least one" and indefinite articles such as "a" or "an," e.g., "a" and/or "an" should be interpreted to mean "at least one" or "one or more;" the same holds true for the use of definite articles used to introduce claim recitations. In addition, even if a specific number of an introduced claim recitation is explicitly recited, those skilled in the art will recognize that such recitation should be interpreted to mean at least the recited number, e.g., the bare recitation of "two recitations," without other modifiers, means at least two recitations, or two or more recitations. Furthermore, in those instances where a convention analogous to "at least one of A, B, and C, etc." is used, in general such a construction is intended in the sense one having skill in the art would understand the convention, e.g., "a system having at least one of A, B, and C" would include but not be limited to systems that have A alone, B alone, C alone, A and B together, A and C together, B and C together, and/or A, B, and C together, etc. In those instances where a convention analogous to "at least one of A, B, or C, etc." is used, in general such a construction is intended in the sense one having skill in the art would understand the convention, e.g., "a system having at least one of A, B, or C" would include but not be limited to systems that have A alone, B alone, C alone, A and B together, A and C together, B and C together, and/or A, B, and C together, etc. It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

From the foregoing, it will be appreciated that various implementations of the present disclosure have been described herein for purposes of illustration, and that various modifications may be made without departing from the scope and spirit of the present disclosure. Accordingly, the various implementations disclosed herein are not intended to be limiting, with the true scope and spirit being indicated by the following claims.

What is claimed is:

1. A device, comprising:

a trigger control unit configured to be removably installed on a grip frame of a semi-automatic firearm and installed between the grip frame and a slide assembly of the semi-automatic firearm, the trigger control unit comprising at least:

a trigger pin; and a trigger pivotable around the trigger pin when pulled, wherein, responsive to the trigger being pulled by a user when the trigger control unit is installed between the grip frame and the slide assembly, a firing pin lug of a striker-firing mechanism in the slide assembly is released thereby allowing a striker of the striker-firing mechanism to move forward with respect to the slide assembly, wherein the trigger control unit is secured to the grip frame at least by the trigger pin such that removal of the trigger control unit from the grip frame requires removal of the trigger pin, and wherein a serial number of the firearm is displayed on the trigger control unit.

2. The device of claim 1, wherein the trigger control unit further comprises:

a trigger mechanism housing; and a trigger bar coupled between the trigger and the trigger mechanism housing, wherein, responsive to the trigger being pulled by the user when the trigger control unit is installed between the grip frame and the slide assembly, the trigger bar causes a sear in the trigger mechanism housing to lower relative to the slide assembly such that the firing pin lug is released.

3. The device of claim 2, wherein the trigger control unit further comprises:

a support frame having a first distal end and a second distal end opposite the first distal end, wherein the trigger is pivotably coupled to the first distal end of the support frame with the trigger pin traversing through the trigger and the first distal end of the support frame, and wherein the trigger mechanism housing is coupled to the second distal end of the support frame.

4. The device of claim 3, wherein the support frame is made of a polymeric material, metal or a composite of metal and polymer.

5. The device of claim 3, wherein the trigger control unit further comprises:

a pair of slide rails extending forward from the support frame with respect to the firearm.

6. The device of claim 1, wherein the trigger control unit is configured to be removably installed on each of a plurality of grip frames and installed between each of the plurality of grip frames and each of a plurality of slide assemblies such that:

at least two of the plurality of grip frames have different sizes, different colors, or different sizes and colors, or at least two of the plurality of slide assemblies have different sizes, different colors, different calibers, or any combination thereof.

7. A firearm, comprising:

a grip frame;

a slide assembly containing a striker-firing mechanism therein; and a trigger control unit configured to be removably installed on the grip frame and installed between the grip frame and the slide assembly, the trigger control unit comprising at least:

a trigger pin; and a trigger pivotable around the trigger pin when pulled, wherein, responsive to the trigger being pulled by a user when the trigger control unit is installed between the grip frame and the slide assembly, a firing pin lug of the striker-firing mechanism in the slide assembly is released thereby allowing a striker of the striker-firing mechanism to move forward with respect to the slide assembly, and wherein the trigger control unit is secured to the grip frame at least by the trigger pin such that removal of the trigger control unit from the grip frame requires removal of the trigger pin, and wherein a serial number of the firearm is displayed on the trigger control unit.

8. The firearm of claim 7, wherein the trigger control unit further comprises:

a trigger mechanism housing; and a trigger bar coupled between the trigger and the trigger mechanism housing, wherein, responsive to the trigger being pulled by the user when the trigger control unit is installed between the grip frame and the slide assembly, the trigger bar causes a sear in the trigger mechanism housing to lower relative to the slide assembly such that the firing pin lug is released.

9. The firearm of claim 8, wherein the trigger control unit further comprises:

a support frame having a first distal end and a second distal end opposite the first distal end, wherein the trigger is pivotably coupled to the first distal end of the support frame with the trigger pin traversing through the trigger and the first distal end of the support frame, and wherein the trigger mechanism housing is coupled to the second distal end of the support frame.

10. The firearm of claim 9, wherein the support frame is made of a polymeric material, metal or a composite of metal and polymer.

11. The firearm of claim 9, wherein the trigger control unit further comprises:

a pair of slide rails extending forward from the support frame with respect to the firearm.

* * * * *